US010253936B2

(12) United States Patent
Ogg et al.

(10) Patent No.: US 10,253,936 B2
(45) Date of Patent: Apr. 9, 2019

(54) MODULAR LED TROFFER SYSTEM

(71) Applicant: Hubbell Incorporated, Shelton, CT (US)

(72) Inventors: Jeremy William Ogg, Rockland, MA (US); Cory Anthony Passerello, Plymouth, MA (US); Jeffrey Richard Schoepf, Marshfield, MA (US)

(73) Assignee: Hubbell Incorporated, Shelton, CT (US)

( * ) Notice: Subject to any disclaimer, the term of this patent is extended or adjusted under 35 U.S.C. 154(b) by 190 days.

(21) Appl. No.: 15/268,073

(22) Filed: Sep. 16, 2016

(65) Prior Publication Data

US 2017/0074473 A1 Mar. 16, 2017

Related U.S. Application Data

(60) Provisional application No. 62/219,460, filed on Sep. 16, 2015.

(51) Int. Cl.

| | |
|---|---|
| ***F21S 8/02*** | (2006.01) |
| ***F21V 21/04*** | (2006.01) |
| ***F21V 23/00*** | (2015.01) |
| *F21V 23/06* | (2006.01) |
| *F21Y 115/10* | (2016.01) |
| *F21V 7/00* | (2006.01) |

(52) U.S. Cl.
CPC ..... *F21S 8/026* (2013.01); *F21V 21/04* (2013.01); *F21V 23/008* (2013.01); *F21V 7/0016* (2013.01); *F21V 23/06* (2013.01); *F21Y 2115/10* (2016.08)

(58) Field of Classification Search
None
See application file for complete search history.

(56) References Cited

U.S. PATENT DOCUMENTS

| | | | |
|---|---|---|---|
| 4,518,896 | A | 5/1985 | Miles |
| 7,862,214 | B2 | 1/2011 | Trott et al. |
| 2004/0184264 | A1 | 9/2004 | Elam et al. |

OTHER PUBLICATIONS

PCT/US2016/052229 International Search Report and Written Opinion dated Feb. 6, 2017 (18 pages).

*Primary Examiner* — Elmito Breval
(74) *Attorney, Agent, or Firm* — Michael Best & Friedrich, LLP

(57) ABSTRACT

A luminaire system includes a frame configured to be positioned in a drop ceiling and connected to a support. A junction housing is connected to the frame and has a high voltage input and a low voltage output. A control component is positioned in the junction housing for converting a high voltage power supply to a lower voltage power supply. A first low voltage conductor extends from the junction housing. A light engine includes a housing containing a light emitter, and a second low voltage conductor extending from the housing. The light engine is releasably connected to the frame and the second low voltage conductor is releasably connected to the first low voltage conductor.

20 Claims, 2 Drawing Sheets

MODULAR LED TROFFER SYSTEM

RELATED APPLICATION(S)

This application is based on U.S. provisional application Ser. No. 62/219,460, filed Sep. 16, 2015, the disclosure of which is incorporated herein by reference in its entirety and to which priority is claimed.

FIELD

Various exemplary embodiments relate to luminaires and systems and methods for replaceable, modular lighting devices.

BACKGROUND

Luminaires, or light fixtures, are used with electric light sources to provide aesthetic and functional housing in both interior and exterior applications. Various types of interior luminaires include overhead, ceiling, ceiling system, or suspended luminaires, which are designed to be positioned near, or suspended from, the ceiling, for example in a drop ceiling.

A common lighting assembly used in ceilings of commercial buildings includes a troffer with one or more downwardly-facing luminous or light emitting devices mounted therein. The lighting fixture can have a removable grid or reflector attached to the housing to allow access to the light emitting device for replacement. The reflectors are generally mounted to the housing. Other forms of lighting assemblies include a hinged or removable cover and a lens and reflector that cooperate with the lamps. The lamps are positioned inside the lens and the reflector is spaced from the lens to direct the light to preselected areas to be illuminated.

SUMMARY

According to an exemplary embodiment, a luminaire system includes a frame configured to be positioned in a drop ceiling and connected to a support. The frame has one or more side walls. A junction housing is connected to the frame and has a high voltage input and a low voltage output. A control component is positioned in the junction housing for converting a high voltage power supply to a lower voltage power supply. A first low voltage conductor extends from the junction housing. A light engine includes a housing containing a light emitter, and a second low voltage conductor extending from the housing. The light engine is releasably connected to the frame and the second low voltage conductor is releasably connected to the first low voltage conductor.

According to another exemplary embodiment, a ceiling mounted luminaire system includes a support member having a plurality of side walls defining an opening in a ceiling. A frame is connected to the support, and includes a junction housing having a high voltage input and a low voltage output. A control component is positioned in the junction housing for converting a high voltage power supply to a lower voltage power supply. A high voltage conductor supplies high voltage power to the control component. A first low voltage conductor extends from the junction housing. A light engine includes a housing containing a light emitter, and a second low voltage conductor extending from the housing. The light engine is releasably connected to the frame and the second low voltage conductor is releasably connected to the first low voltage conductor.

According to another exemplary embodiment, a method of installing and servicing a luminaire includes connecting a frame to a support, the frame having a junction housing a control component positioned in the junction housing, and a low voltage conductor extending from the junction housing. A first individual connects a high voltage power supply to the control component. A second individual connects a light engine to the frame and connects the low voltage conductor to the light engine.

BRIEF DESCRIPTION OF THE DRAWINGS

The aspects and features of various exemplary embodiments will be more apparent from the description of those exemplary embodiments taken with reference to the accompanying drawings.

DETAILED DESCRIPTION OF EXEMPLARY EMBODIMENTS

Figure 1:
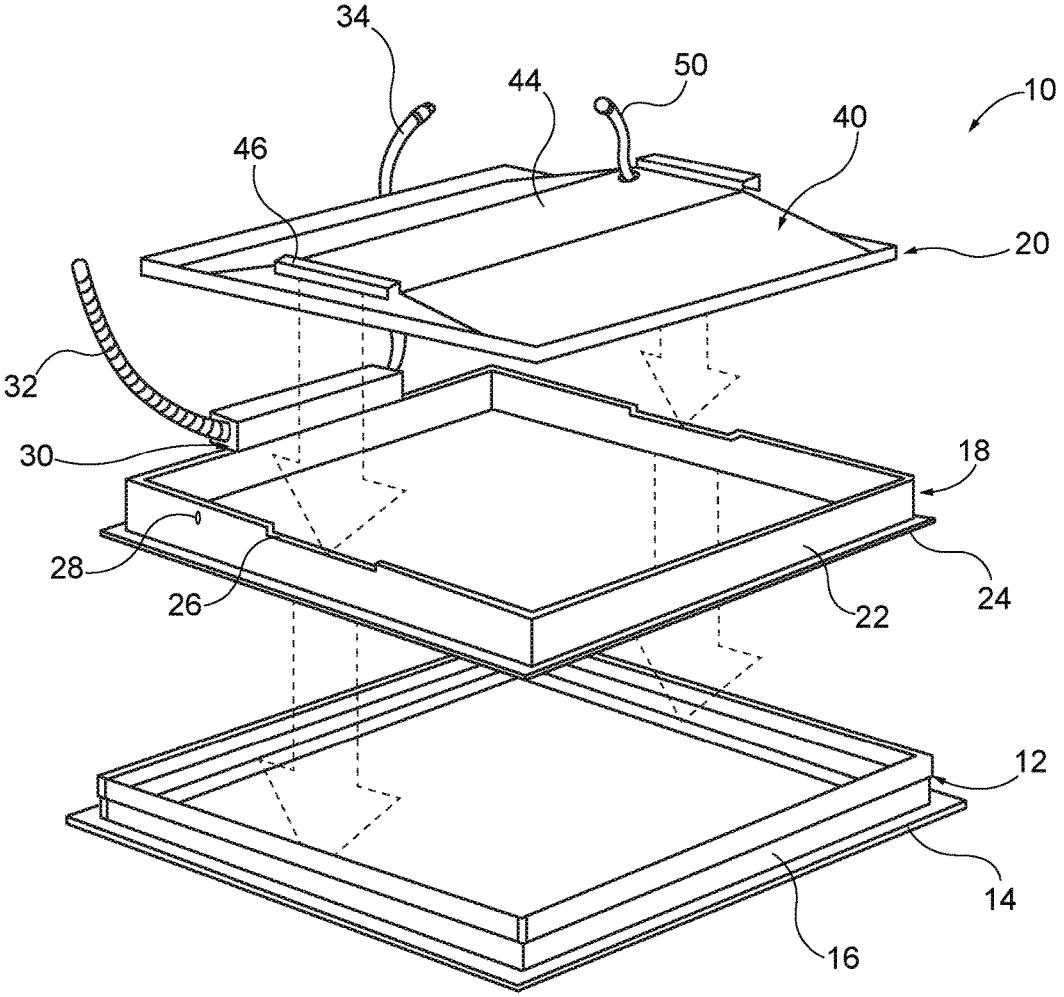
FIG. 1 is an assembly view of an exemplary lighting assembly and support.
Figure 2:
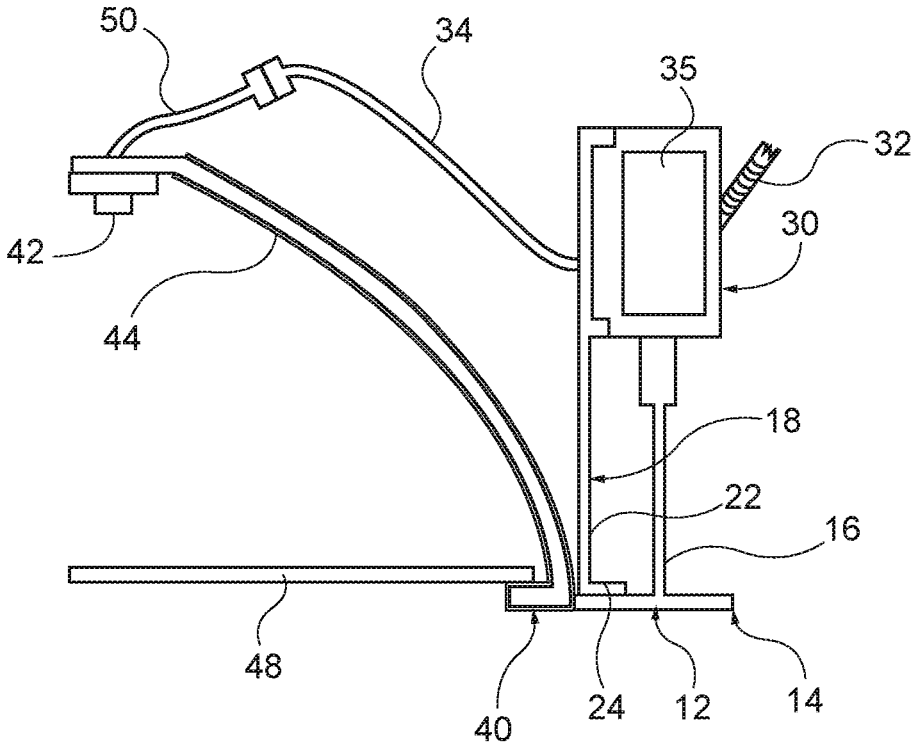
FIG. 2 is a sectional view of FIG. 1 with the lighting assembly connected to the support.

FIGS. 1 and 2 show an exemplary embodiment of a lighting assembly 10 for use in a drop ceiling. The lighting assembly 10 utilizes one or more light emitting devices, for example Light Emitting Diodes (LEDs), fluorescents, halogens, or other types of lamps. The lighting assembly 10 is positioned on or connected to a support 12, shown here as a drop ceiling grid member formed by a set of rails, each having a lower flange 14 and a vertically extending walls 16 defining a opening in a ceiling. Although a four sided support 12 is shown, drop ceiling grids can extend over large areas and include different sizes, shapes, and configurations of openings.

The lighting assembly 10 includes a frame 18 and a light engine 20. The frame 18 has one or more side walls 22 defining an interior portion and a flange 24 extending from the side walls 22 away from the interior portion. Two of the sidewalls include a connecting portion, for example the notch 26 shown in FIG. 2. The frame 18 is positioned on or connected to the support 12. For example, the side walls 22 of the frame 18 can be positioned on the inside of the side walls 16 of the support 12, with the flange 24 of the frame 18 resting on the flange 14 of the support 12. The frame 18 can also include one or more openings 28 extending through the side walls 22 that allow the frame 18 to be tied to the ceiling or other structure to provide additional support. A wire or cable can extend through the openings 28 and then be tied or crimped to the ceiling as would be understood by one of ordinary skill in the art.

The frame 18 includes a junction housing 30. The junction housing 30 extends from an upper edge of the frame 18 and can be attached to the frame 18 by mechanical fasteners that can include brackets, clips, screws, bolts, or other mounting features. The junction housing 30 can also be integrally formed with the frame 18. The junction housing 30 includes a high voltage input and a low voltage output. The high voltage input receives or is electrically connected to a supply, for example a building power supply, for example via a high voltage conductor 32. A low voltage conductor 34 extends from the junction housing 30 to provide a low voltage power supply to the light engine 20. A control component, such as driver or ballast 35 is positioned in the junction housing 30 to convert the high voltage input to a low voltage output. Various forms of connectors and/or conductors can be used on the high and low voltage sides as would be understood by one of ordinary skill in the art. In an exemplary embodiment, the low voltage conductor 34 includes a plug or other type of quick connector.

According to an exemplary embodiment, the light engine 20 is a separate unit from the frame 18 and includes a housing 40 containing a light source, for example one or more LEDs 42 positioned in the housing 40 as shown in FIG. 2. The housing 40 at least partially defines a central cavity and includes a shell 44 with an interior surface that can act as a reflector for the LEDs 42. The housing 40 includes one or more connecting portions to connect the light engine 20 to the frame 18. In exemplary embodiment of FIG. 1, the connection portions include a pair of arms 46 that align with and connect to the notches 26 in the frame 18. The arms 46 have a hook configuration with an upper portion that rests on or is secured within the upper edge of the notch 26 and an outer portion which extends adjacent to an outer surface of the side wall 20 beneath the notch 26, preventing or resting movement in a first direction, while the edges of the notch 26 prevent movement in a second direction. A lens 48 is positioned below the LEDs 42 to diffuse or otherwise direct the light emitted by the LEDs 42. Other lenses and reflectors may also be used to direct the emitted light. The light engine 20 also includes a low voltage conductor 50 for connecting the light engine 20 to the low voltage output of the junction housing 30.

The light engine 20 is configured to be releasably connected to the frame 18. The light engine 20 mechanically interfaces with the frame 18 to provide proper alignment of the light emitters and to keep the light engine 20 from falling from ceiling or other support structure 12. During installation, the light engine 20 can be installed from below the frame 18 by angling the light engine to pass it through the interior portion of the frame 18 and then turning the light engine 20 to rest on top of the frame 18.

Although a troffer style frame 18 and light engine 20 are shown, aspects of the exemplary embodiments described herein can be used with different types and styles of light fixtures, including troffers and other light fixtures of different sizes, shapes, and configurations. Additionally, the various exemplary embodiments are described for use with drop ceilings but can also be incorporated into light fixtures supported on other surfaces, including vertical walls, and other types of ceilings.

Based on the above exemplary principles, various exemplary embodiments also include systems and methods of installing a light fixture. Electrical codes require a licensed electrician to make high voltage connections, but allow anyone to make a low voltage electrical connection and thus anyone is able to service and install the light engine 20 after a licensed professional has installed the frame 18 and made the high voltage connection. Separation of high and low voltages allows customization and interchangeability between light engine aesthetic designs, as well as replacements or upgrades in technology advances. For example, after the initial set-up of the frame 18 in a building, a user can select and customizes specific light engines 20 to be placed at specific locations based on different utility and design considerations. Different considerations can include power usage, light output, and aesthetics. Once the user selects the desired light engine or engines 20, a non-licensed individual can install them. A non-licensed individual can also change or upgrade the light engines 20 as desired.

Additional exemplary embodiments also include systems and methods for providing a subscription based lighting service for indoor and outdoor facilities, including homes and businesses. In various exemplary embodiments, a user can pay a fee or monthly/yearly fees as part of a subscription to be able to change or update light assemblies a set intervals. A user can have one or more light engines 20 changed at the set interval, which may be, for example, annually or biennially. The opportunity to switch light engines may provide an opportunity to enable lighting manufacturers to create contract plans around changing out the light engine based on aesthetic or technology updates. By utilizing the frame 18, a high voltage connection can be established prior to installation of the light engine 20 and an unlicensed person can change the light engine 20 at less expense.

The foregoing detailed description of the certain exemplary embodiments has been provided for the purpose of explaining the principles of the application and examples of practical implementation, thereby enabling others skilled in the art to understand the disclosure for various embodiments and with various modifications as are suited to the particular use contemplated. This description is not necessarily intended to be exhaustive or to limit the application to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire system comprising:

a frame configured to be positioned in a drop ceiling and connected to a support, the frame having one or more side walls;

a junction housing connected to the frame having a high voltage input and a low voltage output;

a control component positioned in the junction housing for converting a high voltage power supply to a lower voltage power supply;

a first low voltage conductor extending from the junction housing;

a light engine having a housing containing a light emitter, and a second low voltage conductor extending from the housing, wherein the light engine is releasably connected to the frame and the second low voltage conductor is releasably connected to the first low voltage conductor, wherein the first low voltage conductor and the second low voltage conductor are releasably connected externally to the frame and the light engine housing.

2. The luminaire system of claim 1, wherein the frame is a troffer style frame.

3. The luminaire system of claim 1, wherein the frame includes a flange extending from the side walls.

4. The luminaire system of claim 1, wherein the first low voltage conductor includes a first connector and the second low voltage conductor includes a second connector mateable with the first connector.

5. The luminaire system of claim 1, wherein the light emitter includes one or more LEDs.

6. The luminaire system of claim 1, wherein the housing includes a first arm and a second arm.

7. The luminaire system of claim 6, wherein the frame includes a first notch and a second notch and the first arm is configured to engage the first notch and the second arm is configured to engage the second notch to align the light engine on the frame.

8. The luminaire system of claim 1, wherein the frame includes an opening extending through one of the side walls to receive a tie-off wire.

9. A ceiling mounted luminaire system comprising:

a support member having a plurality of side walls defining an opening in a ceiling;

a frame connected to the support, the frame including a junction housing having a high voltage input and a low voltage output;

a control component positioned in the junction housing for converting a high voltage power supply to a lower voltage power supply;

a high voltage conductor supplying the high voltage power to the control component;

a first low voltage conductor extending from the junction housing;

a light engine having a housing containing a light emitter, and a second low voltage conductor extending from the housing, wherein the light engine is releasably connected to the frame and the second low voltage conductor is releasably connected to the first low voltage conductor, wherein the first low voltage conductor and the second low voltage conductor are releasably connected externally to the frame and the light engine housing.

10. The ceiling mounted luminaire system of claim 9, wherein the support includes a first flange and the frame includes a second flange resting on the first flange.

11. The ceiling mounted luminaire system of claim 9, wherein the first low voltage conductor includes a first connector and the second low voltage conductor includes a second connector mateable with the first connector.

12. The ceiling mounted luminaire system of claim 11, wherein the first and second connectors are plug type connectors.

13. The ceiling mounted luminaire system of claim 9, wherein the frame includes a first connecting feature and the light engine housing includes a second connecting feature.

14. The ceiling mounted luminaire system of claim 13, wherein the first connecting feature includes a notch and the second connecting feature includes an arm.

15. The ceiling mounted luminaire system of claim 9, wherein the control component includes a driver.

16. The ceiling mounted luminaire system of claim 9, wherein the junction housing is integrally formed with the frame.

17. A method of installing and servicing a luminaire comprising:

connecting a frame to a support, the frame having a junction housing a control component positioned in the junction housing, and a low voltage conductor extending from the junction housing;

having a first individual connect a high voltage power supply to the control component;

having a second individual connect a light engine to the frame and connect the low voltage conductor to the light engine, wherein the low voltage conductor extends externally from the frame and the junction housing to the light engine.

18. The method of claim 17, wherein the first individual is a licensed electrician and the second individual is not a licensed electrician.

19. The method of claim 17, wherein a user selects the light engine from a variety of types.

20. The method of claim 17, further comprising providing a subscription based service that allows a user to replace light engines at set intervals.

* * * * *